US006030002A

United States Patent [19]

Charley et al.

[11] Patent Number: 6,030,002

[45] Date of Patent: Feb. 29, 2000

[54] BORDER CLING DECAL AND PRODUCTION PROCESS THEREFOR

[75] Inventors: Richard A. Charley, Woodbury; Robert M. Paakh, Cedar, both of Minn.

[73] Assignee: The Miner Group, Limited, Minneapolis, Minn.

[21] Appl. No.: 08/810,142

[22] Filed: Feb. 25, 1997

[51] Int. Cl.[7] ..... B42D 15/00

[52] U.S. Cl. ..... 283/81

[58] Field of Search ..... 283/81, 101, 105, 283/56, 117; 428/195, 203, 206, 207, 211

[56] References Cited

U.S. PATENT DOCUMENTS 3,574,656 4/1971 Sauntson et al. ..... 428/704.4

4,804,572 2/1989 Bedrogi ..... 428/203

5,484,638 1/1996 Crabtree ..... 428/203 X

*Primary Examiner*—Willmon Fridie, Jr.

*Attorney, Agent, or Firm*—Mackall, Crounse & Moore, PLC

[57] ABSTRACT

A multi-color border cling decal suitable for application to a smooth surface comprising a long strip of translucent film wound into a coil or about a core. One side of the translucent film is flexographically printed with a multi-color border design then covered with a very thin layer of varnish. The continuous process for making the border cling decal comprising the steps of: (1) flexographically printing a multi-color design on one side of an unwinding roll of translucent film; (2) covering that design with a very thin layer of varnish; (3) winding a predetermined length of printed and varnished film about a core.

14 Claims, 2 Drawing Sheets

BORDER CLING DECAL AND PRODUCTION PROCESS THEREFOR

BACKGROUND

This invention relates to decorative window decals and more particularly to a border cling decal that is contained in roll format so that it may be unrolled and cut to a user's desired length. This invention also relates to the production process for making the border cling decal.

Decorative window decals have been available to the purchasing public for a number of years. However, the majority of these window decals are of specific shapes and sizes that are meant to be placed randomly about the center of a window, the decals held in place via static cling. These window decals usually come in a sheet configuration in which the user must peel the desired decal out of the sheet. There are no decals that allow one to edge an object, e.g. create a border around the outer perimeter of an object or surface such as a window or mirror.

Further, most window decals are produced through a lithographic offset printing process. Lithographic offset printing requires that individual sheets of paper or film be fed through decal printing presses. Numerous sheets of paper or film are inherently difficult to handle. Moreover, if the sheet feeder malfunctions delays in the output of product can result, and if the paper sheets become misaligned unacceptably imperfect decals can result.

In light of the above, there is a need for a process in which a border cling decal can be created via a continuous process to produce a long length of a border cling decal such that it may be contained on a roll so that it may be unrolled and cut to a user's desired length.

SUMMARY

A multi-color border cling decal suitable for application to a smooth surface comprising a long strip of translucent film wound into a coil or about a core. One side of the translucent film is flexographically printed with a multi-color border design then covered with a very thin layer of varnish. The continuous process for making the border cling decal comprising the steps of: (1) flexographically printing a multi-color design on one side of an unwinding roll of translucent film; (2) covering that design with a very thin layer of varnish; (3) winding a predetermined length of printed and varnished film about a core.

An object and advantage of the invention is that the border cling decal is produced via a flexographic printing process which allows for the border to be made in a continuous roll format instead of sheet format.

Another object and advantage of the invention is that mirror-image printing is used. As such, the border design is created by printing on only one side of the film yet the border design gives the impression that it has been printed on both sides of the film.

Yet another object and advantage of the invention is that the roll format of the border cling decal allows the user to cut the border cling decal to the desired length, no piecing of lengths is required.

Still another object and advantage of the invention is that the border design and exposed film is protected by a very thin layer of varnish that is cured by ultra-violet light.

DRAWINGS

These and other features, aspects, and advantages of the present invention will become better understood with regard to the following description, appended claims, and accompanying drawings where:

FIG. 5 depicts an application of the border cling decal namely, framing a window.

DETAILED DESCRIPTION

Figure 3A:
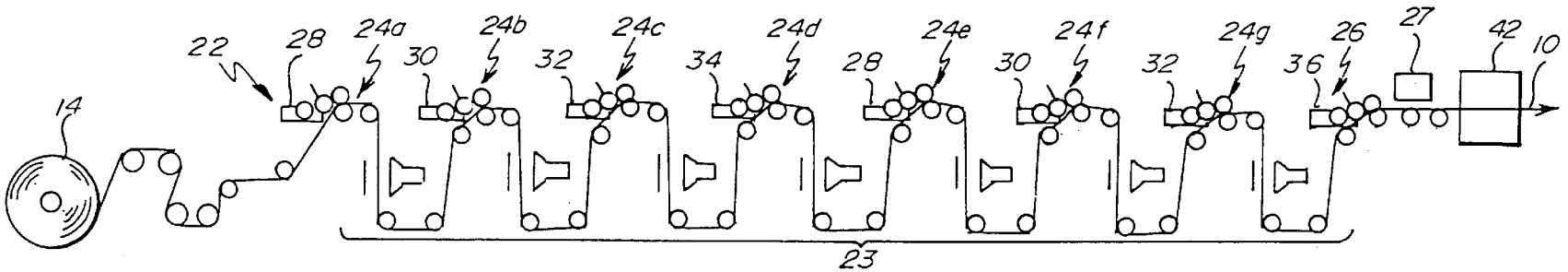
Figure 3B:
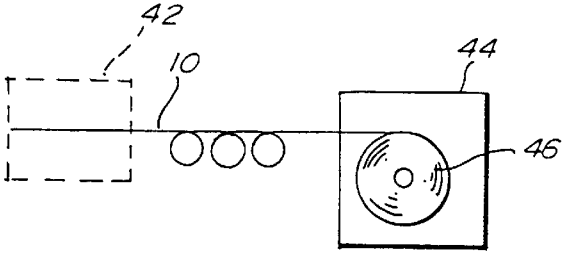
Figure 3C:
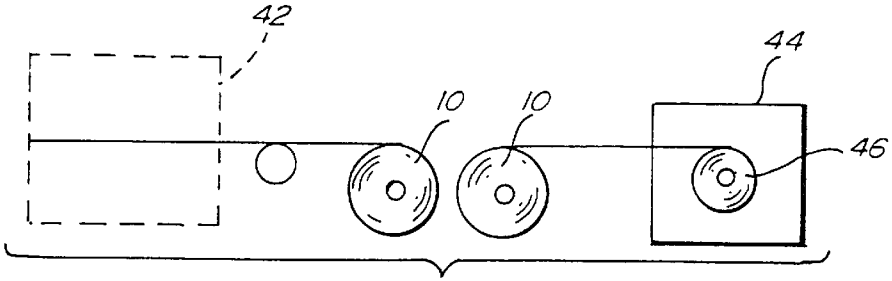
Figure 2:
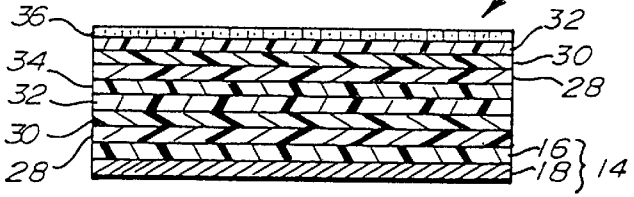
FIG. 2 depicts the elemental layers of the border cling decal.

The border cling decal 10, generally seen in FIGS. 1, 2, 4 and 5, comprises a translucent film 16 that is coiled or wound about a core, a flexographically printed border design 20, and a layer of translucent varnish 36 atop the design 20. The border cling production process 22, see FIGS. 3A–3C, is a continuous process utilizing suitably flexographic printing.

The border cling production process 22 begins with a continuous roll of film material 14. While any number of film materials 14 may be used, an appropriate choice for the film material 14 is the "FLEXCON" six mil static cling. The "FLEXCON" six mil static cling is a topcoated highly plasticized clear (or translucent) cling vinyl film 16 on a one sided poly coated semi bleached clay coated kraft carrier sheet 18. This product, having item designation "FLEX-MARK" CV-600-C T/C-245 80 PW, is available from FLEXCON, 1 FLEXCON Industrial Park, Spencer, Mass. 01562-2642.

The roll of film material 14, which is usually anywhere between 1500–5000 feet in length and approximately 7½ inches to 10 inches in width, is fed into a flexographic printing press machine 23. A machine 23 such as the "WBBTRON" 750, available from Webtron, 2030 W. McNab Road, Fort Lauderdale, Fla. 33309, is suggested. The film material 14 is continuously fed into the machine 23 and through its flexographic print stations 24*a*–24*g*. At each print station 24*a*–24*g*, one side of the translucent film 16 of the film material 14 is flexographically printed with a portion of the border design 20. Each additional print station 24*a*–24*g* adds another ink color and another portion of the border design 20. Each print station 24*a*–24*g* incorporates a dryer 25 that dries the ink that has been flexographically printed on the film 16 before it continues to the next print station 24*a*–24*g*. The final station of the process is a varnish station 26. Here, the smooth surface rollers of the station 26 apply a very thin layer of varnish 36 to the border design 20 and non-printed areas of the translucent film 16. The film material 14 is then passed under an ultra-violet light 27 to cure the varnish 36 and produce a high gloss.

While any number of colors, in any order, might be used to create the border design 20, the preferred method involves mirror-image printing wherein the translucent film 16 is printed with a sequence of colors which are then topped with an opaque white 34, the opaque white 34 then topped with the identical sequence of colors. For example, an eight station set-up, as shown in FIG. 3A, might be used in which the first station 24*a* flexographically prints the film 16 with a yellow ink 28, the second station 24*b* with a magenta ink 30, the third station 24*c* with a cyan ink 32, the fourth station 24*d* with the opaque white 34, the fifth station 24*e* with the yellow ink 28 again, the sixth station 24*f* with the magenta ink 30 again, the seventh station 24*g* with the cyan ink 32 again, and the final station 26 with a varnish 36 as described above, see the individual layers in FIG. 2. The result of the mirror image printing is that the border design 20 appears as though it has been printed on both sides of the translucent film 16 when in fact the printing has occurred on only one side.

The inks chosen for the flexographic printing should be appropriate to the film material 14. In the case of the "FLEXCON" film material 14, Werneke 4000 Series inks are appropriate. The Werneke 4000 Series inks, available from Louis O. Werneke Company, 15500 28th Ave. No., Plymouth, Ma. 55447, are all-purpose water based inks designed primarily for use on non-porous synthetic stocks (film). The 4000 series inks have excellent adhesion and gloss, very good wet and dry rub resistance and create a very thin border design 20 layer. In light of the preferred inks, a preferred varnish is the "SURECURE" UV20010, also available from the Louis O. Werneke Company. The UV-20010 is an overprint varnish that is an ultra violet light curing clear coat for use on most papers and boards as well as many plastics. Further, the UV-20010 has a very fast cure rate with virtually all ultra violet bulbs in commercial use and has excellent gloss.

Figure 1:
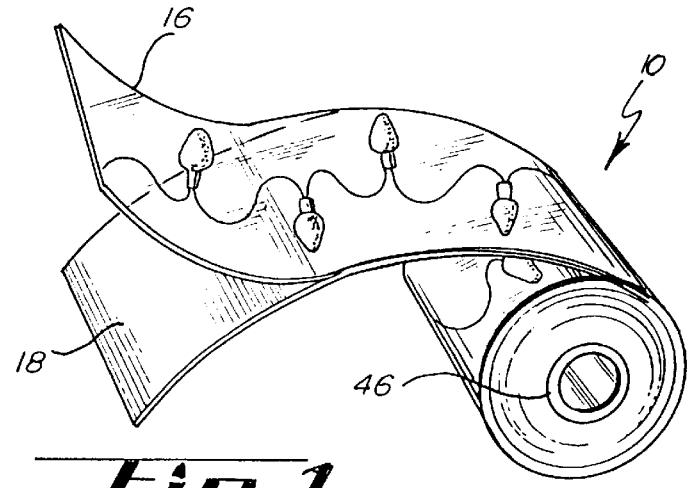
FIG. 1 depicts the border cling decal in roll format with its removable carrier sheet.
Figure 3:
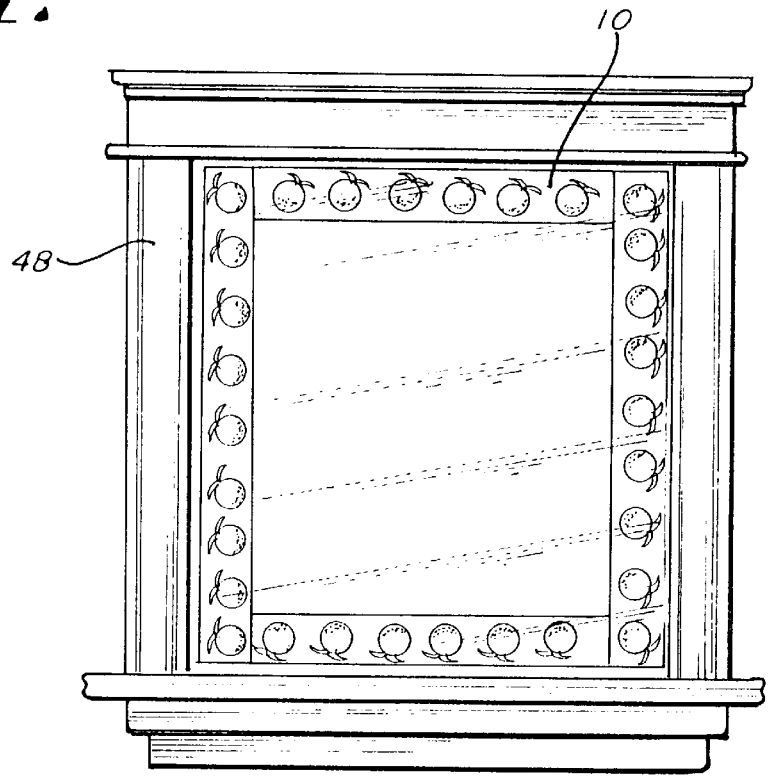
FIG. 3A depicts the printing and varnishing portion of the border cling decal production process.
FIG. 3B depicts the winding and cutting portion of the border cling decal production process.
FIG. 3C depicts the winding and cutting portion of the border cling decal production process wherein the winder is located separate from the printing machine.
Figure 4:
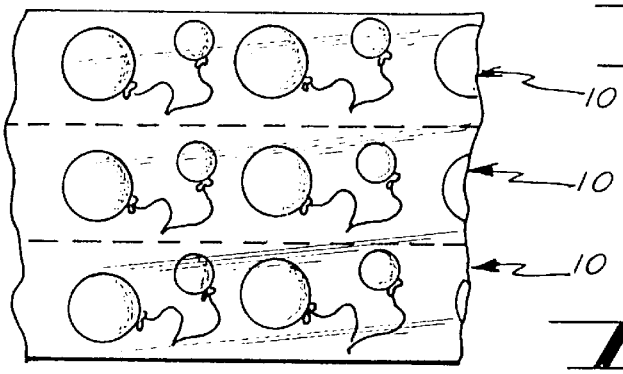
FIG. 4 depicts a possible cutting configuration for the border cling decal production process.

The final step in the border cling decal production process 22 is to wind the decal 10 about a core 46. Any length of border decal 10 may be wound about the core 46 however, the preferred length is twelve feet—long enough to border any surface the user might have yet short enough to be economically feasible and conveniently useful for the user. The core 46 is generally a cardboard core that is preferably from one to three inches in diameter (core diameter determined by user's preference and winder specifications). As described earlier, the width of the film material 14 is approximately seven and one-half inches and as such, may accommodate one or more printed border designs 20. FIG. 4 shows an instance in which the seven and one-half inch width incorporates three border designs 20. Once the film material 14 has been wound about the core by a winder 44, the winder's slitters (not shown) cut through the border cling decal 10 and core 46 to produce the individual rolls of the border cling decal 10, see FIG. 1. As shown in FIG. 3B, the winder 44 may be located directly after the flexographic printing machine 23 allowing for a completely continuous process or alternatively, as shown in FIG. 3C, the winder 44 may be a separate station. In the instance where the winder 44 is a separate station, it is necessary to coil the border cling decal 10 into a roll for transfer to the winder 44.

While the preferred method is to wind the border cling decal 10 about a core 46, the border cling decal 10 might also be wound into a coil, absent the core 46, or sheeted into long strips, e.g. twelve foot long strips. In these instances, the use of a cutting station 42 would come into play. Anywhere from one to four cutting stations 42 might be incorporated into the process as necessary. The cutting station 42, which is generally a standard die-cutting station, may perform the functions of slitting, rotary die cutting, sheeting, scoring, embossing, debossing and/or laminating as necessary for either the roll producing or sheet producing process.

Still another alternative to the production process 22, is to use roll or web fed offset printing in place of the flexographic printing to produce the border cling decal 10. In the case of offset printing, the width of the film material 14 can be much larger than the aforementioned 7½ inch to 10 inch width. Rotary screen or roto gravure printing may also be used.

The border cling decal 10 may be applied to any surface, preferably a smooth surface, via static cling. The border cling decal 10 adheres especially well to glass such as windows and mirrors. As shown in FIG. 5, the border cling decal 10 might be applied to a window 48 in such a fashion as to create a frame. To actually apply the border cling decal 10 to a surface one need only unroll the border cling decal 10, cut it to the desired length, peel back the carrier paper 18 from the film 16, and press the film 16 to the surface.

The present invention may be embodied in other specific forms without departing from the essential attributes thereof; therefore, the illustrated embodiment should be considered in all respects as illustrative and not restrictive, reference being made to the appended claims rather than to the foregoing description to indicate the scope of the invention.

What is claimed:

1. A multi-color border cling decal suitable for static-cling application to a smooth surface, comprising:

(a) a long strip of translucent film wound into a coil and adapted to static cling to the smooth surface;

(b) a multi-color design flexographically printed on one side of said translucent film; and (c) a very thin layer of varnish covering said design.

2. The decal of claim 1, wherein said multi-color design is printed in mirror-image format.

3. The decal of claim 1, wherein said design is created with water based inks.

4. The decal of claim 1, wherein said smooth surface is a glass surface.

5. The decal of claim 1, wherein said layer of varnish creates a gloss on said film and design.

6. The decal of claim 1, wherein said long strip is at least twelve feet in length.

7. The decal of claim 1, wherein the coil is wound about a core.

8. The decal of claim 1, further comprising a removable carrier sheet, said removable carrier sheet adjacent the non-printed side of said film.

9. A multi-color border cling decal suitable for static cling application to a smooth surface, comprising:

(a) a long strip of translucent cling vinyl film wound about a core and adapted to static cling to the smooth surface;

(b) a very thin multi-color design flexographically printed on one side of said translucent cling vinyl film in mirror-image format; and (c) a very thin layer of translucent varnish covering said design.

10. The decal of claim 9, wherein said design is created with water based inks.

11. The decal of claim 9, further comprising a removable carrier sheet, said removable carrier sheet adjacent the non-printed side of said film.

12. The decal of claim 9, wherein said smooth surface is a glass surface.

13. The decal of claim 9, wherein said long strip is at least twelve feet in length.

14. The decal of claim 9, wherein said core has a diameter in the range of one to three inches.

* * * * *